US007038194B2

(12) United States Patent
Tomita

(10) Patent No.: US 7,038,194 B2
(45) Date of Patent: May 2, 2006

(54) MULTIPLE-BEAM SCANNING DEVICE AND IMAGE FORMING APPARATUS INCLUDING THE MULTIPLE-BEAM SCANNING DEVICE

(75) Inventor: Yasumasa Tomita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 301 days.

(21) Appl. No.: 10/644,839

(22) Filed: Aug. 21, 2003

(65) Prior Publication Data

US 2004/0061046 A1 Apr. 1, 2004

(30) Foreign Application Priority Data

Aug. 22, 2002 (JP) ..... 2002-241940

(51) Int. Cl.
*H01J 3/14* (2006.01)

(52) U.S. Cl. ..... 250/236; 359/205; 347/233

(58) Field of Classification Search ..... 250/234–236; 347/233, 241–244; 359/204–208
See application file for complete search history.

(56) References Cited

U.S. PATENT DOCUMENTS 5,963,240 A * 10/1999 Shinohara et al. ..... 347/116
6,535,317 B1 * 3/2003 Ishibe ..... 359/205
6,756,583 B1 * 6/2004 Yamawaki ..... 250/234

FOREIGN PATENT DOCUMENTS

| | | |
|---|---|---|
| JP | 5-241087 | 9/1993 |
| JP | 7-113973 | 5/1995 |
| JP | 9-90187 | 4/1997 |

OTHER PUBLICATIONS

U.S. Appl. No. 10/644,839, filed Aug. 21, 2003, Tomita.
U.S. Appl. No. 10/733,246, filed Dec. 12, 2003, Serizawa et al.

* cited by examiner

*Primary Examiner*—Thanh X. Luu
(74) *Attorney, Agent, or Firm*—Oblon, Spivak, McClelland, Maier & Neustadt, P.C.

(57) ABSTRACT

A multiple-beam scanning device of the present invention includes a light source unit provided with a plurality of light sources. A deflector deflects, in the main scanning direction, light beams issuing from the light sources. Optics condenses the light beams deflected by the deflector with optical devices having power in the subscanning direction main scanning direction, respectively, in such a manner as to establish a preselected beam spot diameter, and returns an optical path with at least one mirror for thereby scanning a subject surface. An adjusting device provides, in a plane formed by scanning lines deflected by the deflector, one of the optical devices with α eccentricity about the center of an optical axis in the direction of the optical axis.

20 Claims, 9 Drawing Sheets

MULTIPLE-BEAM SCANNING DEVICE AND IMAGE FORMING APPARATUS INCLUDING THE MULTIPLE-BEAM SCANNING DEVICE

BACKGROUND OF THE INVENTION

1. Field of the Invention

The present invention relates to a laser beam printer, digital copier, laser facsimile apparatus or similar image forming apparatus and a multiple-beam scanning device included in an image forming apparatus and capable of adjusting a beam spot position in the subscanning direction at an end image height.

2. Description of the Background Art

To meet the increasing demand for a high density, high speed image forming apparatus, various schemes have heretofore been proposed in relation to a scanning device or scanning means included in an image forming apparatus. For example, the conventional schemes include one that increases the rotation speed of a polygonal mirror or similar deflector included in the scanning device and one that increases the number of light sources.

Increasing the rotation speed of a deflector, however, brings about noise, vibration, temperature elevation and other problems. These problems cannot be solved without increasing cost. The rotation speed cannot therefore be increased above a certain limit.

On the other hand, to increase the number of light sources, use is made of, e.g., means for combining light beams issuing from a plurality of light sources or a laser diode array including a plurality of light sources or light emitting portions. When high density and high speed are not achievable by increasing the rotation speed of the deflector, increasing the number of light sources, i.e., a so-called multiple-beam scanning device is effective.

The prerequisite with a multiple-beam scanning device is that the distance between nearby beam spot positions in the subscanning direction in an image plane, i.e., a so-called beam pitch be maintained constant. For example, when scanning line density is 600 dpi (dots per inch), the beam pitch must be maintained at 42.3 μm. Such a beam pitch must be insured without regard to the environment in which the scanning device is operated.

In practice, however, the refractive index of an optical device, disposed in an optical scanning device, is not uniform. Moreover, it is impossible to mount the optical device with accuracy precisely equal to designed accuracy due to limited machining accuracy. As a result, light beams from light sources do not accurately pass the focus of the optical device, preventing a desired beam pitch from being established.

In fact, although any desired beam pitch can be implemented by adjustment on, e.g., a production line, the adjustment is effected only at the center of an image or center image height. Consequently, it is likely that the beam pitch at the end image height differs from the beam pitch at the center image height. Particularly, in a color image forming apparatus, a difference between beam pitches at different image heights, i.e., a beam pitch deviation noticeably appears in an image, as known in the art. When a plurality of color prints are output, the tone of color conspicuously varies from one image to another image.

Further, an optical device is generally implemented as an elongate optical device because it scans the surface of a photoconductive element or subject surface. An elongate optical device is extremely susceptible to the variation of refractive index ascribable to the temperature deviation or heat distribution of the environment around the optical device. Consequently, even if adjustment is so made as to establish a preselected beam pitch at the center image height, the preselected beam pitch is unable to be established at an end image height, also resulting in defective images.

The beam pitch deviation between image heights, of course, occurs when parallelism between nearby beams on an image plane is distorted, i.e., when the bends or the inclinations of nearby scanning lines formed by beams differ from each other. However, it is difficult to correct the bend or the inclination of the individual scanning line.

To correct the inclinations of scanning lines, Japanese Patent Laid-Open Publication No. 10-175324, for example, teaches adjusting means configured to angularly move a return mirror in the lengthwise direction. However, providing the return mirror with eccentricity translates into varying optical length between image heights, so that the focus of a beam spot differs from one image height to another image height. This brings about a magnification error in the main scanning direction and the degradation of the beam spot diameter and prevents, in a color image forming apparatus, toner images of different colors from being superposed in accurate register.

Japanese Patent Laid-Open Publication No. 5-24108, for example, proposes to establish a preselected beam pitch by controlling the angle of a return mirror in such a manner as to provide it with β eccentricity. This method, however, cannot correct the beam pitch deviation between different image heights.

Japanese Patent Laid-Open Publication No. 7-113973, for example, teaches means for moving an optical device in the direction of optical axis. A problem with this scheme is that because the optical device is supported by a lens holder, a large number of parts are necessary while the errors of individual parts accumulate during assembly. Consequently, adequate optical characteristics are not attainable without increasing the accuracy of the individual parts, resulting in an increase in cost.

Moreover, none of the conventional schemes described above includes correcting means for a multiple-beam configuration.

Technologies relating to the present invention are also disclosed in Japanese Patent Laid-Open Publication Nos. 5-241087 and 9-90187.

SUMMARY OF THE INVENTION

It is an object of the present invention to provide a multiple-beam scanning device capable of insuring a uniform beam pitch throughout all image heights with a simple configuration.

It is another object of the present invention to provide a multiple-beam scanning device capable of effecting easy adjustment even when a temperature distribution in an apparatus in which the scanning device is positioned is not uniform.

It is a further object of the present invention to provide an image forming apparatus capable of outputting desirable images with the above multiple-beam scanning device.

A multiple-beam scanning device of the present invention includes a light source unit provided with a plurality of light sources. A deflector deflects, in the main scanning direction, light beams issuing from the light sources. Optics condenses the light beams deflected by the deflector with optical devices having power in the subscanning direction main scanning direction, respectively, in such a manner as to establish a preselected beam spot diameter, and returns an optical path with at least one mirror for thereby scanning a subject surface. An adjusting device provides, in a plane formed by scanning lines deflected by the deflector, one of the optical devices with a eccentricity about the center of an optical axis in the direction of the optical axis.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
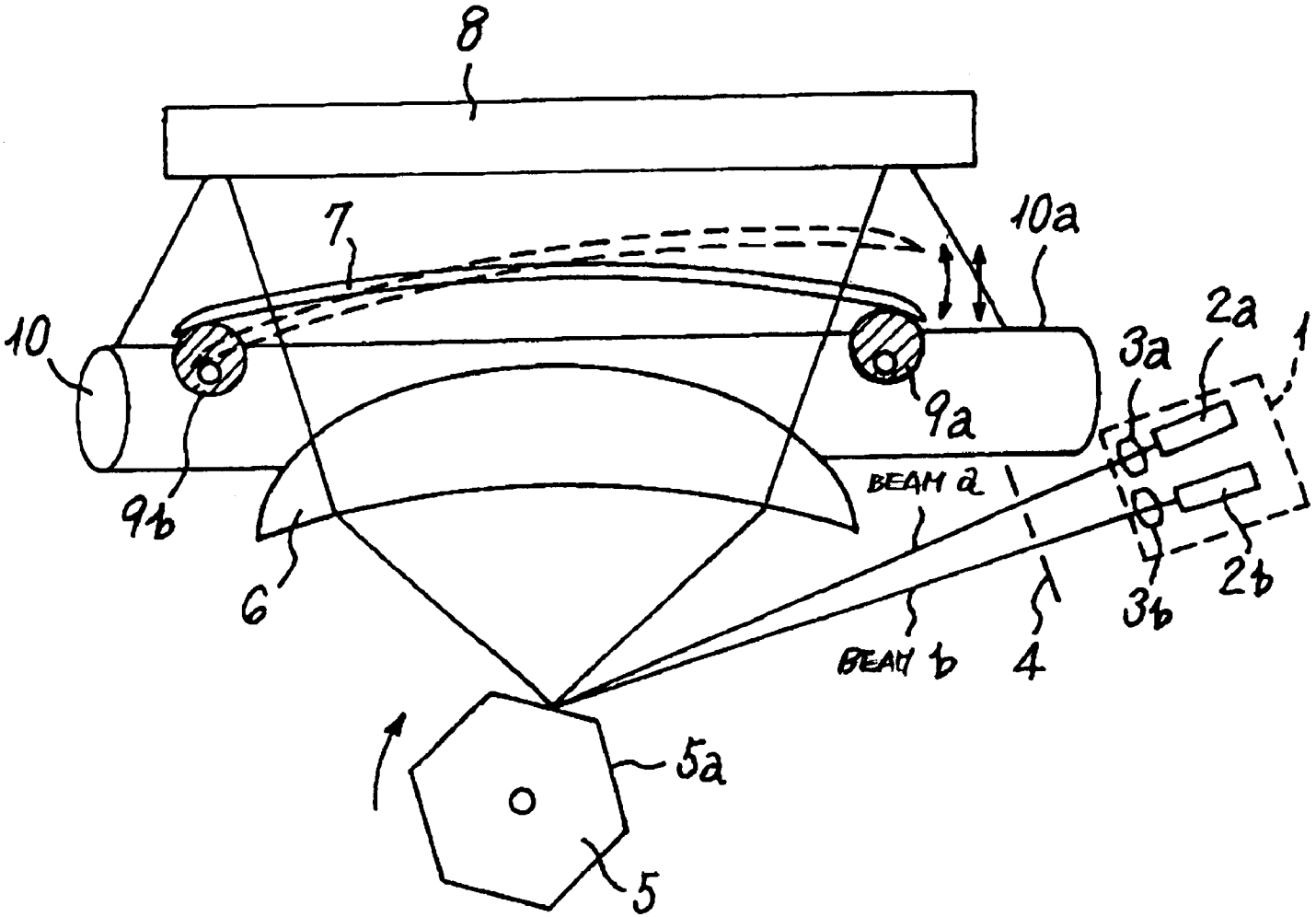
FIG. 1 is a view showing the general configuration of a multiple-beam scanning device embodying the present invention.
Figure 2:
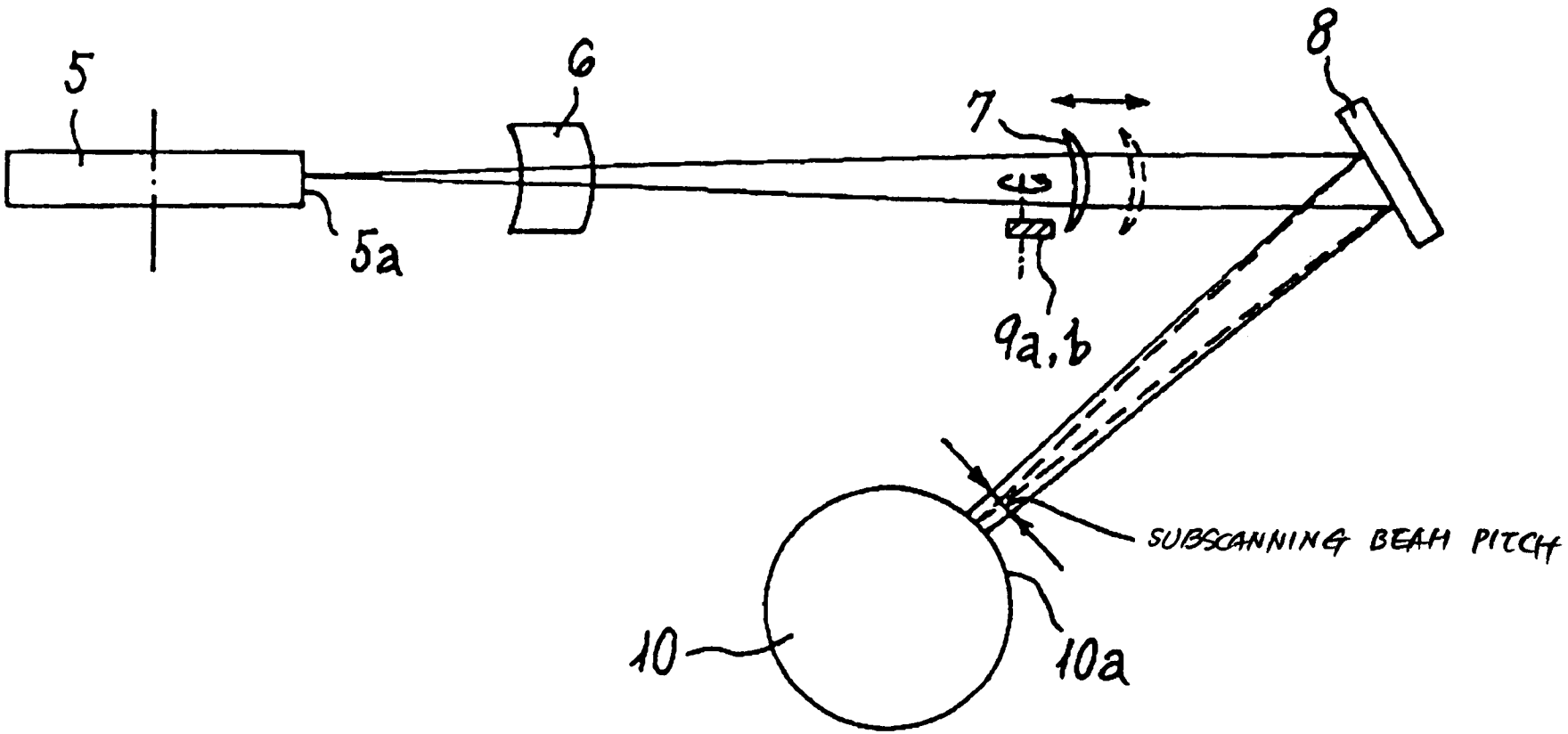
FIG. 2 is a section showing the illustrative embodiment as seen in the subscanning direction.

Referring to FIGS. 1 and 2 of the drawings, a multiple-beam scanning device embodying the present invention is shown. As shown, the multiple-beam scanning device includes a light source unit 1 including a plurality of light sources 2*a* and 2*b* and collimator lenses 3*a* and 3*b*. Light beams, issuing from the light sources 2*a* and 2*b*, are collimated by the collimator lenses 3*a* and 3*b*, respectively, and then output from the light source unit 1 as substantially parallel light beams a and b. An aperture 4 restricts the parallel light beams a and b in such a manner as to implement a preselected beam spot diameter. Subsequently, a polygonal mirror or similar deflector 5 deflects the light beams so restricted by the aperture 4.

The light beams deflected by the deflector 5 are input to optics including optical devices 6 and 7 that have power in the main and subscanning directions, respectively. This optics is configured to return the input light beams with at least one mirror 8. Consequently, the light beams form fine beam spots on the surface or subject surface 10*a* of an image carrier 10 and scan the surface 10*a* in the main scanning direction.

While the light source unit 1 is assumed to have two light sources, the crux is that it includes a plurality of light sources, e.g., laser diodes and a beam splitter or similar means for combining beams issuing from the light sources. Further, the light source unit 1 may be implemented as a laser diode array, i.e., a single light emitting device including a plurality of light sources.

Figure 9:
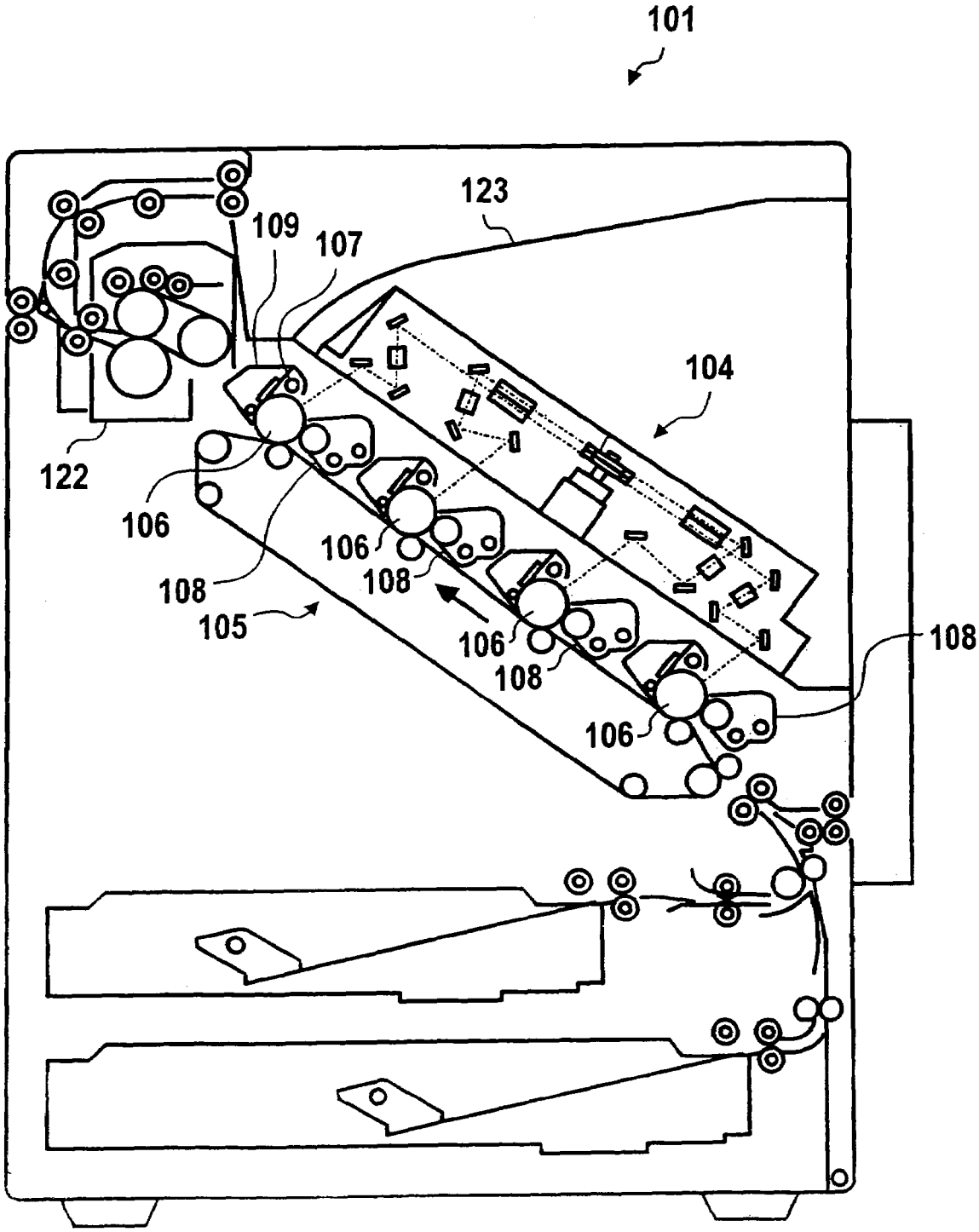
FIG. 9 is a view showing a general configuration of an image forming apparatus according to an embodiment of the present invention.

Referring to FIG. 9, a specific configuration of an image forming apparatus in accordance with the present invention will be described hereinafter. In the image forming apparatus 101, the image carrier 10 shown in FIGS. 1 and 2 is implemented as a photoconductive drum 106. Arranged around the photoconductive drum 106 are charging means 107, optical writing means 104 including the multiple beam scanning device described above, developing means 108, image transferring means 105, cleaning means 109, and discharging means. The charging means 107, implemented as a charger, a charge roller or a charge brush by way of example, uniformly charges the surface of the photoconductive drum 106. The multiple-beam scanning device scans the charged surface of the photoconductive drum 106 with the light beams modulated in accordance with image data to thereby form a latent image. The developing means 108 develops the latent image with toner to thereby form a corresponding toner image and is implemented as a developing unit using a single-component developer, i.e., toner or a two-component developer, i.e., a toner and carrier mixture.

The image transferring means 105 transfers the toner image formed on the photoconductive drum 106 to a sheet or recording medium either directly or indirectly via an intermediate image transfer body. In a direct image transfer system, the image transferring means 105 may be implemented as, e.g., a charger, an image transfer roller, an image transfer belt or an image transfer brush. In an indirect image transfer system, the image transferring means 105 may be implemented as a combination of an intermediate image transfer belt, intermediate image transfer drum or similar primary image transferring means and an image transfer charger, image transfer roller, image transfer belt, image transfer brush or similar secondary image transferring means. The cleaning means 109, implemented as a cleaning blade, cleaning brush or a cleaning roller by way of example, removes toner left on the photoconductive drum 106 after the image transfer. Subsequently, the discharging means, implemented as a quenching lamp or a discharger by way of example, removes charges left on the photoconductive drum 106.

The sheet, carrying the toner image formed thereon by the electrophotographic image forming process described above, is conveyed to a fixing unit or fixing means 122. The fixing unit fixes the toner image on the sheet with heat and pressure. Finally, the sheet with the toner image thus fixed is driven out to, e.g., a tray 123.

A specific configuration of a color image forming apparatus will be described hereinafter although not shown specifically. A plurality of developing units adjoin a single drum 10 and form, e.g., a yellow, a magenta, a cyan and a black toner image. Image transferring means is implemented as an intermediate image transfer body. The toner images of different colors, sequentially formed on the drum 10, are sequentially transferred to the intermediate image transfer body one above the other, completing a composite color image. The color image is then transferred from the intermediate image transfer body to a sheet by secondary image transferring means and then fixed on the sheet by fixing means.

A tandem color image forming apparatus includes a plurality of image forming units arranged side by side and respectively assigned to, e.g., yellow, magenta, cyan and black. The image forming units each include a drum, charging means, developing means, exposing means, image transferring means, cleaning means, and discharging means. Toner images of different colors, formed on the drums of the image forming units, are sequentially transferred to a sheet or an intermediate image transfer body one above the other, completing a composite color image.

While the image forming apparatus of the present invention may have any one of the specific constructions described above, it is characterized by using the multiple-beam scanning device shown in FIGS. 1 and 2.

In the optics of the illustrative embodiment, the optical devices 6 and 7, respectively having power in the main and subscanning directions, are assumed to be an fθ lens and an elongate cylindrical lens, respectively.

In accordance with the present invention, the optics is characterized in that the optical device or cylindrical lens 7, having power in the subscanning direction, is adjustable in any desired direction relative to the direction of optical axis. More specifically, adjusting means for providing the cylindrical lens 7 with α eccentricity about the center of optical axis or moving it in parallel to the direction of optical axis is associated with the cylindrical lens 7, so that a desired beam pitch and a desired beam spot diameter can be established.

Figure 3:
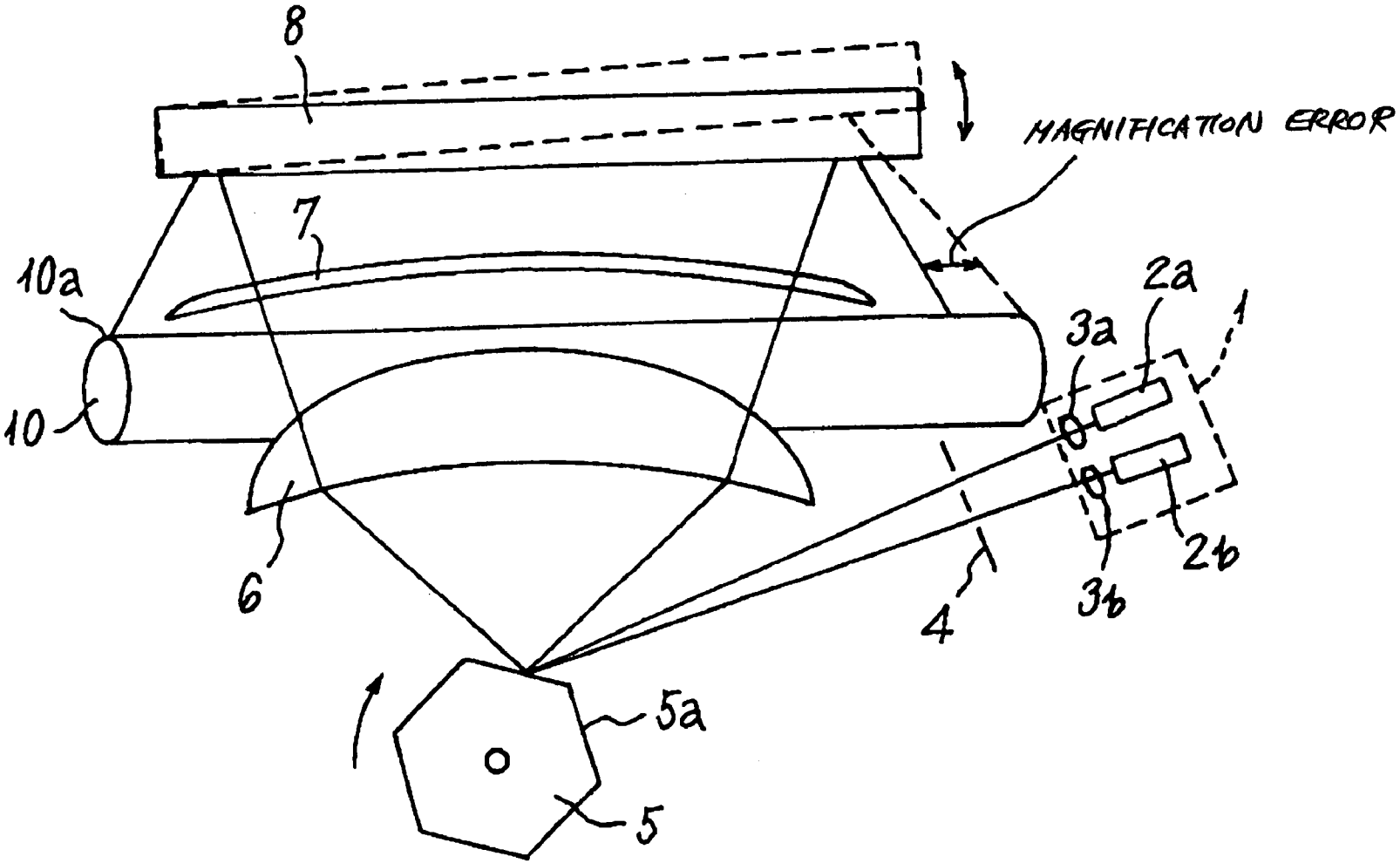
FIG. 3 is a view similar to FIG. 1, showing a multiple-beam scanning device using conventional adjusting means.

As shown in FIG. 3 specifically, it is a common practice to provide the return mirror 8 with eccentricity or angularly move it. This conventional adjusting method, however, causes optical path length to vary and thereby shifts the focus of a beam spot. Consequently, there occur a magnification error in the main scanning direction and the degradation of beam spot diameter. Such an adjusting method therefore cannot meet the increasing demand for a color image forming apparatus having more accurate beam spot positions or a smaller beam spot diameter. By contrast, in accordance with the present invention, it is possible to adjust the position of the cylindrical lens 7 without varying optical path length between image heights.

Further, in accordance with the present invention, the optical device 7, having power in the subscanning direction, is implemented as a transparent member or lens, as stated earlier. Therefore, it is possible to control the variation of beam spot diameter during adjustment without varying the distance between the optical device 6, which has power in the main scanning direction, and the drum surface or subject surface 10*a*.

Figure 4:
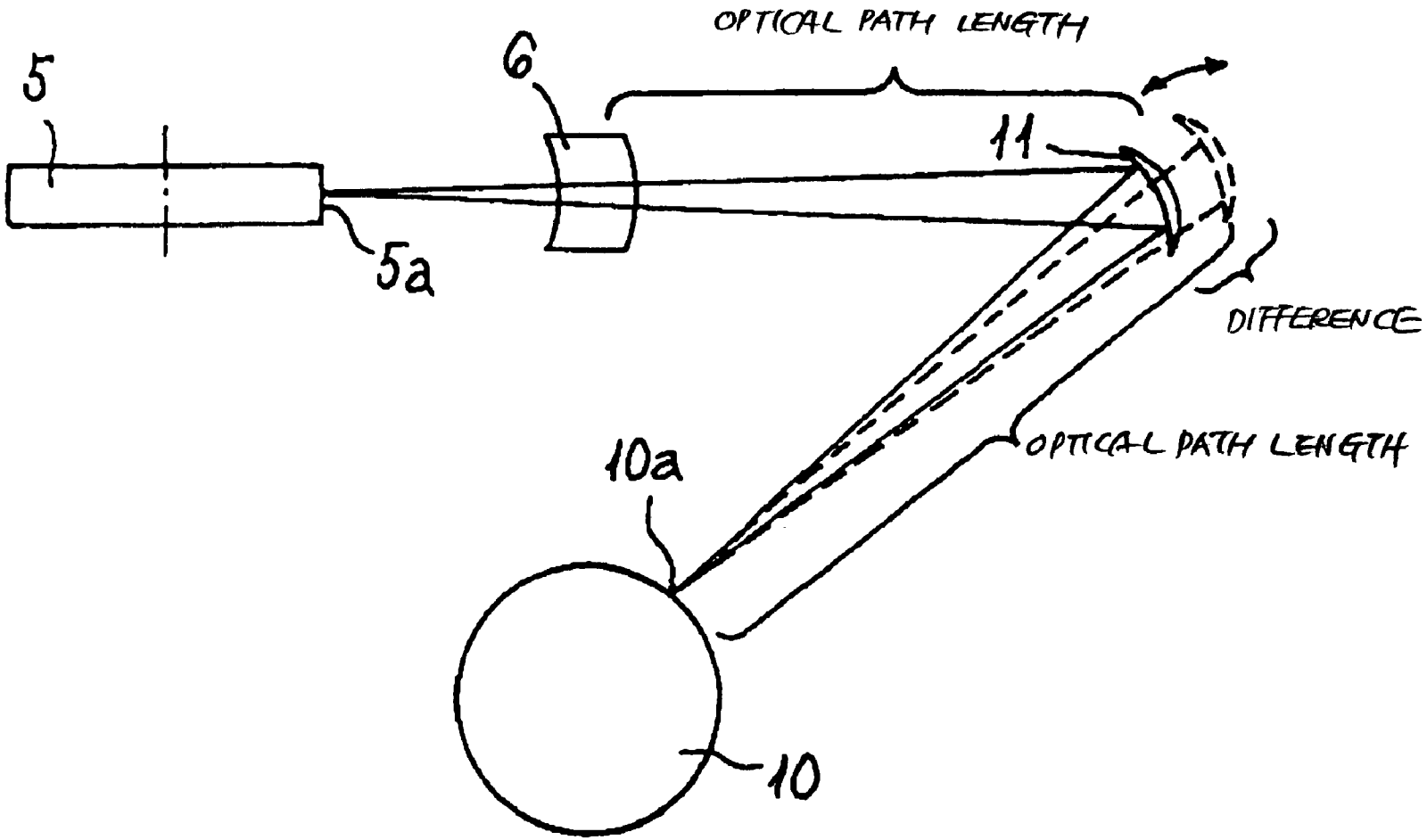
FIG. 4 shows an optical path in a condition wherein an optical device, having power in the subscanning direction, is implemented as a reflecting member and subject to adjustment.

As shown in FIG. 4, assume that the optical device, having power in the subscanning direction, comprises a cylindrical mirror or similar reflecting member 11. Then, when the reflecting member 11 is adjusted in position, optical path length to the surface of the drum 10 and therefore optical path length to the field of the optical device 6, which has power in the main scanning direction, is varied. As a result, not only the beam spot position, expected to be adjusted in the subscanning direction, but also beam characteristics in the main scanning direction, which are originally adequate, are varied. It is therefore impossible to establish both of a desired beam spot diameter and desired beam spot positions in the main and subscanning directions without adjusting the position of the optical device 6 also. The adjustment therefore needs sophisticated adjusting means and cannot easily implement adequate beam characteristics.

Figure 5A:
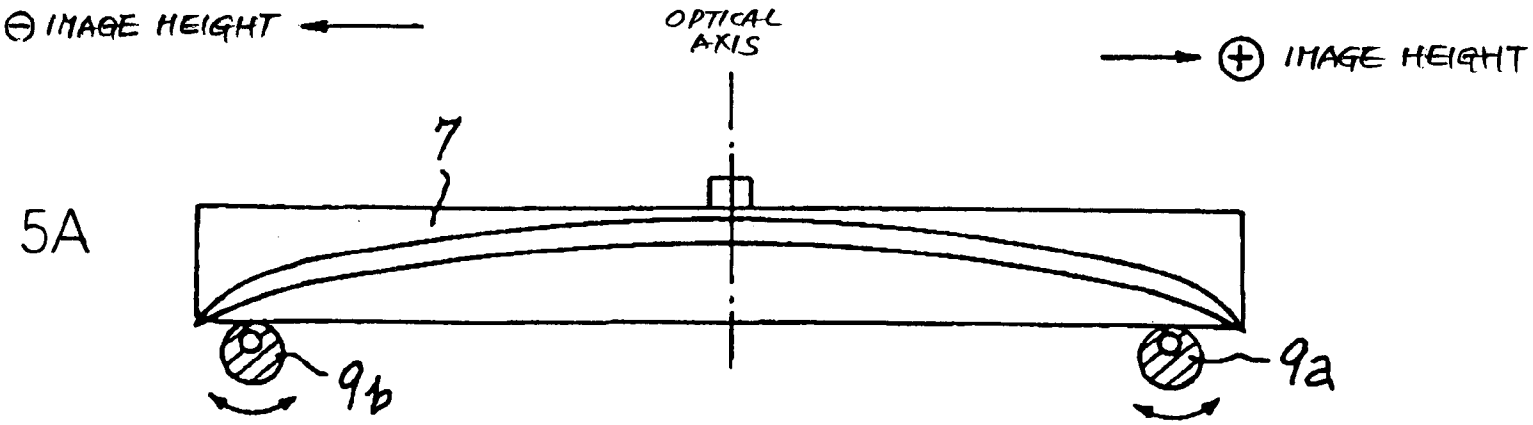
FIGS. 5A and 5B are views showing the configuration and operation of adjusting means included in the illustrative embodiment.
Figure 5B:
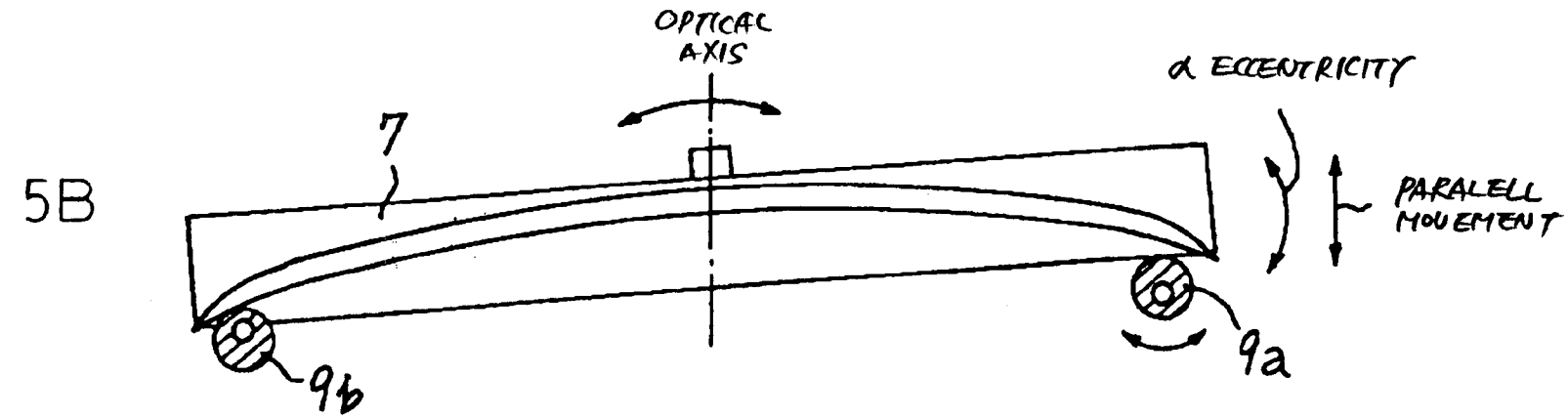

Reference will be made to FIGS. 5A and 5B for describing the general configuration and operation of the adjusting means assigned to the optical device 7. As shown, eccentric cams 9*a* and 9*b*, serving as the adjusting means, are positioned at opposite ends of the cylindrical lens 7 and can be rotated or adjusted independently of each other. More specifically, the eccentric cams 9*a* and 9*b* each can be rotated by a particular amount to thereby provide the cylindrical lens 7 with α eccentricity in the direction of optical axis or move it in parallel to the direction of optical axis, as indicated by arrows in FIG. 5B.

Figure 6:
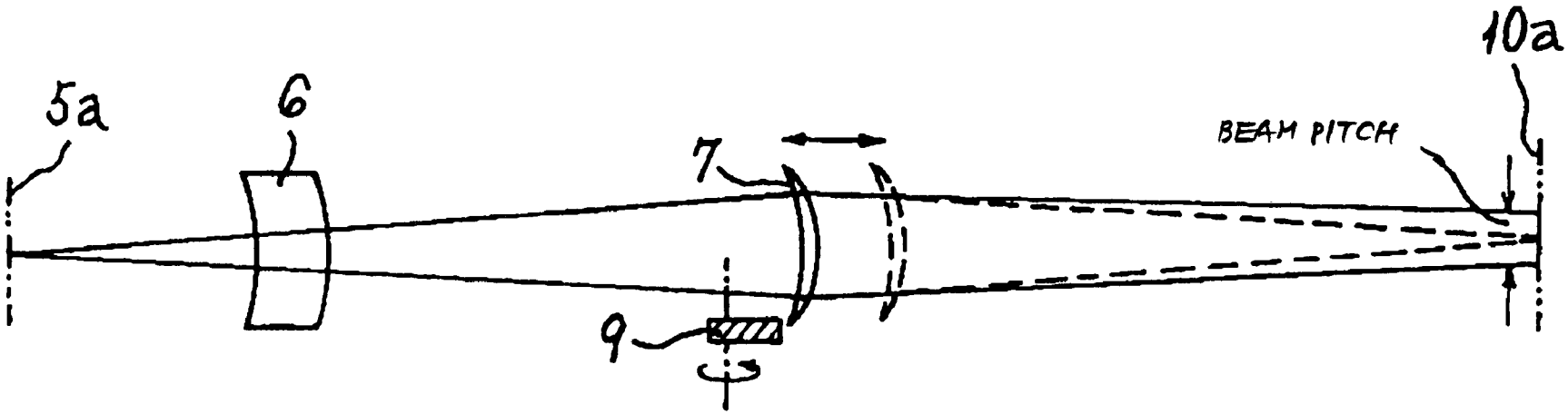
FIG. 6 shows an optical path on which the adjusting means adjusts an optical device.

FIG. 6 shows how the beam spot positions and beam pitch vary when the cams 9*a* and 9*b* are rotated. In FIG. 6, the reflecting surface of the deflector 5 and the surface of the drum 10 to be scanned are designated by the reference numerals 5*a* and 10*a*, respectively.

Figure 7A:
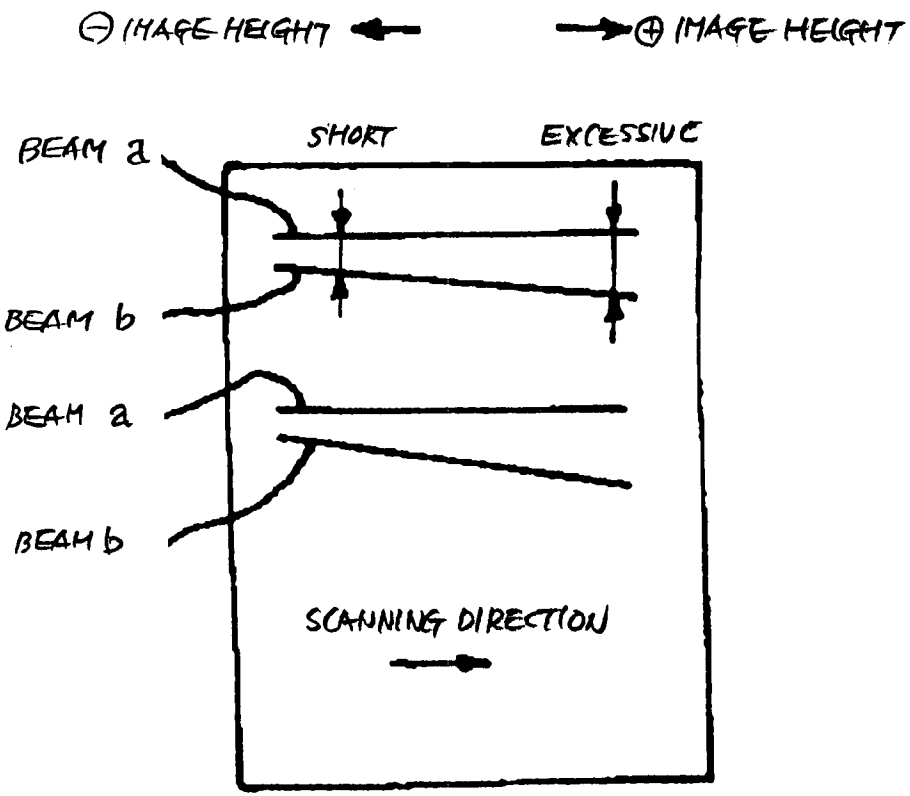
FIGS. 7A and 7B show a specific image not subject to beam pitch adjustment and a specific image subject to the same.
Figure 7B:
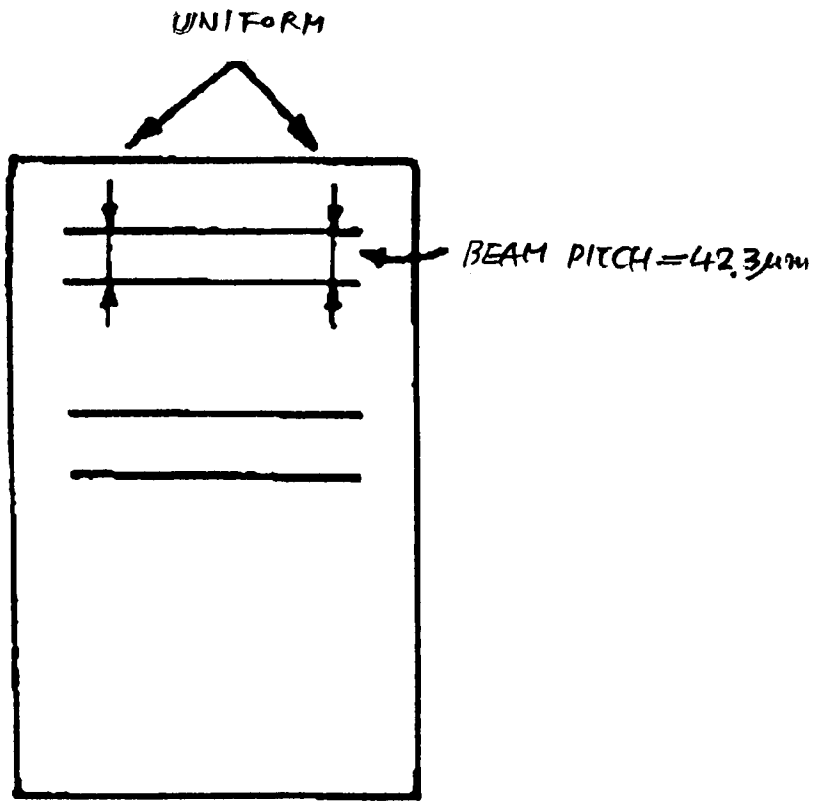

As shown in FIG. 7B, assuming that the scanning optics has resolution of 600 dpi by way of example, then the pitch of the light beams should ideally be 42.3 μm at all image heights without exception. In practice, however, parallelism in inclination and bend between the scanning lines of the light beams is distorted due to irregularity in refractive index inside the cylindrical lens 7 or temperature deviation inside the apparatus. As a result, as shown in FIG. 7A, the preselected beam pitch is sometimes not established at the end image height.

To solve the above problem, the present invention allows, e.g., only the eccentric cam 9*a* positioned at one end of the cylindrical lens 7 to be rotated for providing the cylindrical lens with a eccentricity in the direction of optical axis. This successfully adjusts the beam pitch at the end image height deviated from the ideal value. More specifically, by moving one end of the cylindrical lens 7, it is possible to adjust the beam pitch from one shown in FIG. 7A to one shown in FIG. 7B.

Figure 8A:
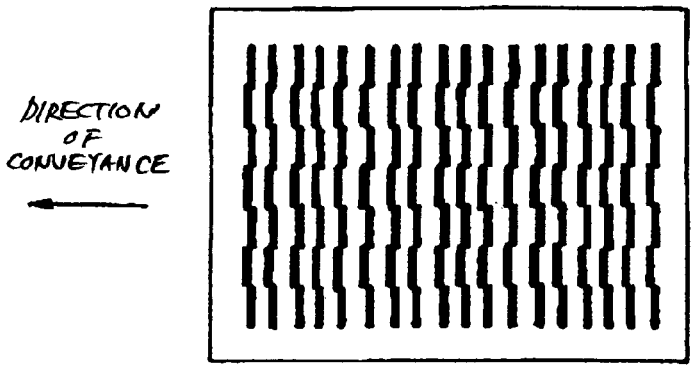
FIGS. 8A through 8C show a specific image pattern to be used for effecting adjustment with the adjusting means.
Figure 8B:
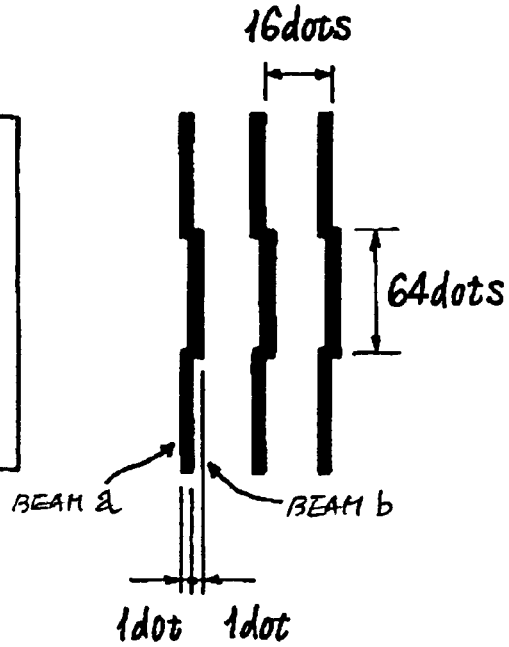
Figure 8C:
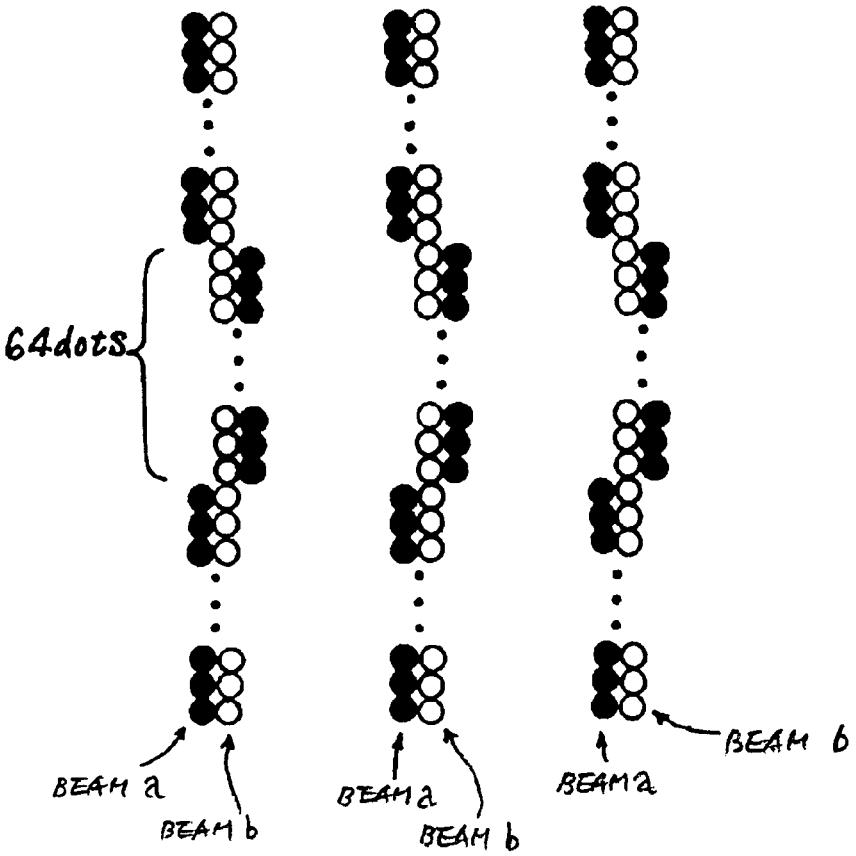

FIG. 8A shows a specific image pattern printed by an image forming apparatus while FIG. 8B shows part of the image pattern in an enlarged view. FIG. 8C shows the same part of the image pattern in a further enlarged view. A person may adjust the beam pitch as stated above so as to uniform the image at all image heights while watching such a printed image pattern.

While the beam pitch can be uniformed at the end image height and center image height by the above a eccentricity of the cylindrical lens 7, it is likely that the adjustment disturbs the beam spot diameter. Further, it may be difficult to establish the desired beam pitch by adjusting only one of the eccentric cams 9*a* and 9*b*.

In light of the above, in accordance with the present invention, another eccentric cam is positioned at the other end of the cylindrical lens 7, so that the lens 7 can be rotated or moved in the parallel direction with respect to, the direction of optical axis, as desired. For example, a person may rotate the right eccentric cam 9*a* (assuming a positive image height) to provide α eccentricity, which makes the scanning lines of the two beams parallel, and then rotate the left eccentric cam 9*b* to establish the preselected beam pitch and beam spot diameter.

By repeating the above adjustment of the eccentric cams 9*a* and 9*b* alternately a plurality of times, it is possible to attain the ideal beam pitch and beam spot diameter.

The adjustment described above can be easily effected not only at the time of shipment but also every time a heat distribution, for example, occurs in the apparatus due to temperature variation during the operation of the apparatus and makes the refractive index of the cylindrical lens 7 irregular.

An electric actuator or a stepping motor may be used to control the eccentric cams 9*a* and 9*b*, in which case the adjustment can be effected at preselected intervals, e.g., every time 100 prints are output. This realizes automatic or maintenance-free correction of the beam pitch for thereby insuring high image quality at all times.

As stated above, in accordance with the present invention, the cylindrical lens 7 can be easily adjusted only if the eccentric cams 9*a* and 9*b* are rotated. A person can therefore easily perform the adjustment in, e.g., an office while watching a printed image, e.g., the pattern shown in FIGS. 8A through 8C. This makes it needless for the product to be collected and readjusted in a factory.

In summary, it will be seen that the present invention provides a multiple-beam scanning device and an image forming apparatus having various unprecedented advantages, as enumerated below.

(1) Adjusting means allows one of optical devices included in optics to be provided with α eccentricity about the center of an optical axis in the direction of the optical axis in a plane formed by scanning lines, which are scanned by a deflector. Therefore, by rotating the above optical axis, it is possible to control a beam pitch at the end image height to preselected one and to uniform the beam pitch in an image plane at all image heights.

(2) One of the optical devices included in the optics is provided with adjusting means for α eccentricity and adjusting means for parallel movement. Therefore, even if the beam pitch established by the above adjustment differs from a desired beam pitch, the beam pitch in the image plane can be uniformed without fail while the beam spot diameter can be controlled to preselected one.

(3) By using an optical device having power in the subscanning direction as the adjustable optical device, it is possible to prevent optical path length to a subject surface from varying at any image height. The adjustment therefore prevents magnification error deviation from varying, i.e., it can be done without disturbing preselected magnification, thereby protecting images from degradation.

(4) The optical device, having power in the subscanning direction, is implemented by an elongate cylindrical lens or similar transparent member. The variation of beam spot diameter can therefore be controlled during adjustment without varying a distance between an optical device, which has power in the main scanning direction, and the subject surface.

(5) The adjusting means, assigned to the optical device having power in the subscanning direction, is implemented by eccentric cams positioned at opposite ends of the optical device. It is therefore possible to adjust beam pitch with a simple configuration including a minimum number of parts and to cope with the variation of beam pitch ascribable to aging.

(6) It is possible to easily adjust beam pitch and beam spot diameter and to cope with the variation thereof ascribable to aging for thereby insuring high image quality at all times.

Various modifications will become possible for those skilled in the art after receiving the teachings of the present disclosure without departing from the scope thereof.

What is claimed is:

1. A multiple-beam scanning device comprising:

a light source unit comprising a plurality of light sources;

a deflector configured to deflect, in a main scanning direction, light beams emitted from said plurality of light sources;

optics configured to condense the light beams deflected by said deflector with an optical device having power in a subscanning direction and an optical device having power in a main scanning direction in such a manner as to establish a preselected beam spot diameter, and to return an optical path with at least one mirror for thereby scanning a subject surface; and an adjusting device configured to provide, in a plane formed by scanning lines deflected by said deflector, one of said optical devices with α eccentricity about a center of an optical axis in a direction of said optical axis.

2. The device as claimed in claim 1, wherein said adjusting device is further configured to adjust a position of said one of said optical devices in parallel to the direction of the optical axis in the plane formed by the scanning lines.

3. The device as claimed in claim 2, wherein said one of said optical devices comprises said optical device having power in the subscanning direction.

4. The device as claimed in claim 3, wherein said adjusting device assigned to said optical device having power in the subscanning direction comprises rotatable eccentric cams positioned at opposite ends of said optical device.

5. The device as claimed in claim 3, wherein said optical device having power in the subscanning direction comprises a transparent member.

6. The device as claimed in claim 5, wherein said adjusting device assigned to said optical device having power in the subscanning direction comprises rotatable eccentric cams positioned at opposite ends of said optical device.

7. The device as claimed in claim 1, wherein said one of said optical devices comprises said optical device having power in the subscanning direction.

8. The device as claimed in claim 7, wherein said adjusting device assigned to said optical device having power in the subscanning direction comprises rotatable eccentric cams positioned at opposite ends of said optical device.

9. The device as claimed in claim 7, wherein said optical device having power in the subscanning direction comprises a transparent member.

10. The device as claimed in claim 9, wherein said adjusting device assigned to said optical device having power in the subscanning direction comprises rotatable eccentric cams positioned at opposite ends of said optical device.

11. An image forming apparatus comprising:

an image carrier;

optical writing means for forming a latent image on said image carrier;

developing means for developing the latent image to thereby produce a corresponding toner image;

image transferring means for transferring the toner image from said image carrier to a recording medium either directly or indirectly via an intermediate image transfer body; and fixing means for fixing the toner image on the recording medium, said optical writing means comprising a multiple-beam scanning device comprising:

a light source unit comprising a plurality of light sources;

a deflector configured to deflect, in a main scanning direction, light beams emitted from said plurality of light sources;

optics configured to condense the light beams deflected by said deflector with an optical device having power in a subscanning direction and an optical device having power in a main scanning direction in such a manner as to implement a preselected beam spot diameter, and to turn back an optical path with at least one mirror for thereby scanning a surface of said image carrier; and adjusting means for providing, in a plane formed by scanning lines deflected by said deflector, one of said optical devices with a eccentricity about a center of an optical axis in a direction of said optical axis.

12. The apparatus as claimed in claim 11, wherein said adjusting means capable of moving said one of said optical devices in parallel to the direction of the optical axis in the plane formed by the scanning lines.

13. The apparatus as claimed in claim 12, wherein said one of said optical devices comprises said optical device having power in the subscanning direction.

14. The apparatus as claimed in claim 13, wherein said adjusting means assigned to said optical device having power in the subscanning direction comprises rotatable eccentric cams positioned at opposite ends of said optical device.

15. The apparatus as claimed in claim 13, wherein said optical device having power in the subscanning direction comprises a transparent member.

16. The apparatus as claimed in claim 15, wherein said adjusting means assigned to said optical device having power in the subscanning direction comprises rotatable eccentric cams positioned at opposite ends of said optical device.

17. The apparatus as claimed in claim 11, wherein said one of said optical devices comprises said optical device having power in the subscanning direction.

18. The apparatus as claimed in claim 17, wherein said adjusting means assigned to said optical device having power in the subscanning direction comprises rotatable eccentric cams positioned at opposite ends of said optical device.

19. The apparatus as claimed in claim 17, wherein said optical device having power in the subscanning direction comprises a transparent member.

20. The apparatus as claimed in claim 19, wherein said adjusting means assigned to said optical device having power in the subscanning direction comprises rotatable eccentric cams positioned at opposite ends of said optical device.

* * * * *